US009204678B1

(12) United States Patent
Brachos et al.

(10) Patent No.: US 9,204,678 B1
(45) Date of Patent: Dec. 8, 2015

(54) HELMET RETENTION SYSTEM

(71) Applicant: Ceradyne, Inc., Salem, NH (US)

(72) Inventors: Vasilios Brachos, North Andover, MA (US); Vincent Borbone, Sandown, NH (US)

(73) Assignee: CERADYNE, INC., Salem, NH (US)

( * ) Notice: Subject to any disclaimer, the term of this patent is extended or adjusted under 35 U.S.C. 154(b) by 503 days.

(21) Appl. No.: 13/629,788

(22) Filed: Sep. 28, 2012

Related U.S. Application Data

(60) Provisional application No. 61/540,260, filed on Sep. 28, 2011.

(51) Int. Cl.
*A42B 3/14* (2006.01)
*A42B 3/08* (2006.01)

(52) U.S. Cl.
CPC .... *A42B 3/08* (2013.01); *A42B 3/14* (2013.01)

(58) Field of Classification Search
CPC ..... A42B 3/08; A42B 3/14
USPC ..... 2/414, 416, 421
See application file for complete search history.

(56) References Cited

U.S. PATENT DOCUMENTS 3,994,023 A * 11/1976 Aileo et al. ..... 2/417
5,150,479 A * 9/1992 Oleson ..... 2/414
5,704,072 A 1/1998 Garneau
5,914,661 A 6/1999 Gross
5,946,735 A 9/1999 Bayes
6,311,338 B1 * 11/2001 Galet ..... 2/421
7,152,253 B2 12/2006 Abelman et al.
RE39,964 E 1/2008 Burek et al.
7,870,617 B2 1/2011 Butler
8,156,574 B2 4/2012 Stokes et al.
2008/0276354 A1 11/2008 Stokes et al.
2010/0281603 A1 * 11/2010 Ho ..... 2/411
2011/0072547 A1 3/2011 Doria et al.
2011/0277223 A1 11/2011 Roberts et al.

OTHER PUBLICATIONS

GL-PD-09-04H Purchase Description (PD) for the Enhanced Combat Helmet, May 3, 2012, 79 pages.

* cited by examiner

*Primary Examiner* — Katherine Moran
(74) *Attorney, Agent, or Firm* — C. Michael Geise

(57) ABSTRACT

A helmet includes a helmet shell including an edge and an edge trim receiving the edge. The helmet also includes a retention system including at least two points where the retention system is secured to the helmet and a releasable mechanical fastening system, wherein the mechanical fastening system includes a first mating portion and a second mating portion, which releasably mates with the first mating portion. The first mating portion is affixed to the points and the second mating portion is affixed to one of the helmet shell or the first mating portion. In addition, an attachment hook is provided for each point of the retention system extending from the edge trim through which each of the points pass through.

19 Claims, 14 Drawing Sheets

HELMET RETENTION SYSTEM

CROSS-REFERENCE TO RELATED APPLICATIONS

The present application claims the benefit of the filing date of U.S. Provisional Application No. 61/540,260, filed on Sep. 28, 2011, the disclosure of which is incorporated herein by reference.

FIELD OF INVENTION

The present disclosure relates to a retention system for a helmet and, in particular, a system for securing straps to a helmet to retain the helmet on the wearer.

BACKGROUND

Helmets, such as ballistic helmets, commonly include retention systems, which may include retention straps or harnesses, for securing the helmet onto a wearer's head. The retention straps may be affixed to the helmet with screws or grommets that pass through holes machined or otherwise formed into the helmet. As a number of helmets are formed of composites, including ballistic composites, it may be very difficult to machine a hole through the helmet to secure the hardware that affixes the retention straps to the helmet. The holes may also form stress concentrations, regardless of the material the helmet is formed of, reducing the overall ballistic protection of the helmet. Further, hardware, such as grommets or screws, may cause additional damage to the wearer when the helmet is hit by a projectile or other object.

SUMMARY

An aspect of the present disclosure relates to a helmet. The helmet includes a helmet shell including an edge and an edge trim receiving the edge of the helmet shell. The helmet also includes a retention system including at least two points where the retention system is secured to the helmet and a releasable mechanical fastening system, wherein the mechanical fastening system includes a first mating portion and a second mating portion, which releasably mates with the first mating portion. The first mating portion is affixed to the points and the second mating portion is affixed to one of the helmet shell or the first mating portion. The first and second mating portions include hook and loop fasteners. In addition, an attachment hook is provided for each point of the retention system extending from the edge trim through which each of the points pass through.

Another aspect of the present disclosure relates to a system for providing a helmet. The system includes a retention system including at least two mating straps, wherein each strap includes a first mating portion. The system also includes a helmet shell including an edge, an edge trim receiving the edge, at least two attachment hooks extending inwardly from the edge trim, and a second mating portion releasably affixed to the first mating portion. The first mating portion passes through one of the attachment hooks and the attachment hook prevents the first mating portion affixed to the second portion from being pulled at an angle of greater than 45 degrees from the helmet shell wall.

A further aspect of the present disclosure relates to a method of securing a retention system of a helmet. The method may include passing a first mating portion provided on a point of a retention system through an attachment hook provided on a helmet and mating the first mating portion to a second mating portion affixed to the helmet and securing the retention system to the helmet.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

Figure 1A:
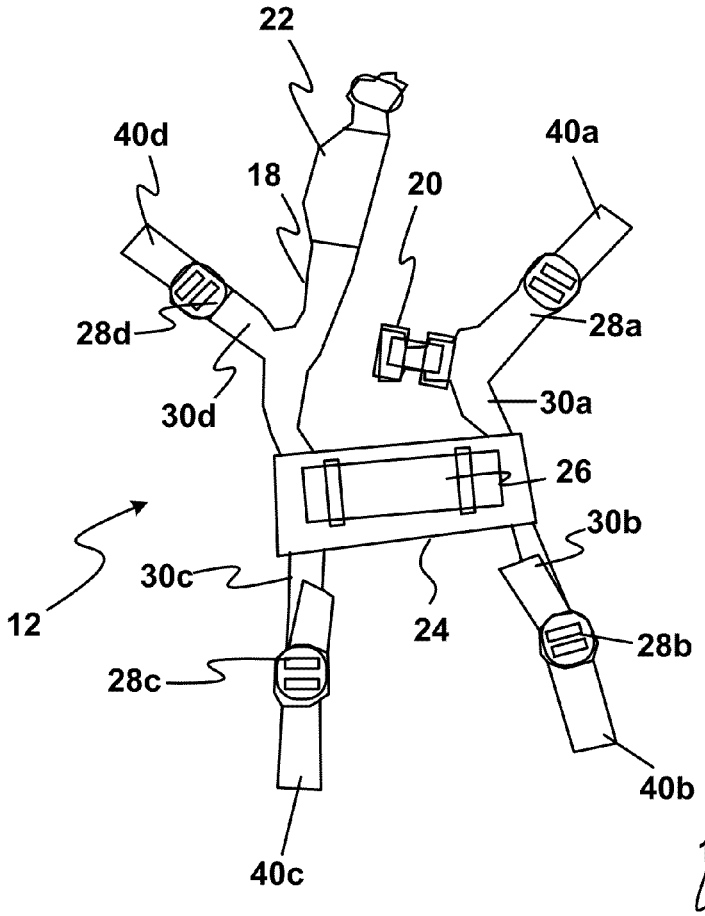
FIG. 1*a* illustrates an embodiment of a retention system including hook fastener strips for securing the retention system to the helmet.

The present disclosure relates to a retention system for a helmet and, in particular, a fastener system for securing a retention system to a helmet to retain the helmet on the wearer. The retention system includes a harness or series of straps that secure a helmet to a user's head. The fastener system may affix the retention system to the helmet in a relatively quick and secure manner without modification to the shell of the helmet.

FIGS. 1*a*, 1*b*, 2*a* and 2*b* illustrate an embodiment of a helmet 10 and fastener systems for affixing the retention system 12 to the surface of the helmet. The helmet includes a shell 14 formed of a single material or multiple materials, such as composites. In some embodiments, the shell 14 is formed from one or more thermoplastics, thermosets, ceramics, metals or metal alloys, and combinations thereof. For example, the shell 14 may be formed from multiple layers of woven or nonwoven fabrics bonded together utilizing a thermoplastic or thermoset adhesive. In some embodiments, the fabrics are formed, for example, from polyester, nylon, polyethylene or polypropylene fibers. In addition, the fibers may be highly oriented fibers. Examples of fibers that are used in the fabrics include fibers such as TWARON (available from Teijin), ZYLON (available from Toyobo Corporation), SPECTRA (available from Honeywell Corporation), DYNEEMA (available from DSM), etc. The fabrics may also be impregnated with various resins, such as vinyl ester resins, polyester resins, epoxy resins, etc. The shell 14 is formed into one of a number of geometries, including for example, low-cut or high-cut combat helmet geometries.

A suspension system 16 is, optionally, provided within the helmet, including one or more liners or pads that may be used to prevent the shell 14 from directly contacting the head or to absorb some of the force exerted by a helmet on a wearer's head when the helmet is hit by an object. The suspension system 16 includes a compliant material such as foam formed from silicone or urethane materials. The compliant material is, optionally, covered in a textile such as woven fabric, nonwoven fabric, leather, or other materials and may be positioned within the helmet shell 14 either in a fixed or adjustable manner. For example, if fixed, the suspension system may be adhered to the shell using a chemical bonding process such as pressure sensitive adhesive, solvent activated adhesive or heat activated adhesive system. Non-limiting examples of adhesive compositions include acrylic, synthetic rubber, polyvinyl acetate, polyvinyl alcohol, acrylates, polyethylene, nylons, cyanoacrylates, epoxies, silicone, phenolics polyurethanes, copolymers thereof, etc. In other embodiments, a fixed suspension system may be ultrasonically or dielectrically welded to the shell. If positioned within the shell in an adjustable manner, the pads or liner may be affixed using mechanical fasteners such as hook and loop fasteners or slid into pockets formed in the helmet. The suspension pads have a thickness in the range of 1 mm to 100 mm, including all values and ranges therein. In addition, varying thicknesses may be used for individual suspension pads provided in a single helmet.

As illustrated in FIGS. 1*a*, 1*b*, 2*a* and 2*b*, the retention system is a four point retention system. In additional embodiments, the retention system 12 includes a two point, three point, five point, six point or additional point harness, wherein the points refer to the places or arms of the harness that the harness is attached to the helmet shell 14 (e.g., a four point harness is affixed to a helmet in four distinct regions). The retention system 12 includes a chin strap 18 that passes underneath the wearer's chin, a neck strap 24 that passes behind the nape of the neck or both. The chin strap 18 and/or neck strap 24 secure the retention device to wearer's head.

The retention system 12 includes a mechanical attachment 20 for opening and closing the chin strap 18. The mechanical attachment may be positioned near the wearer's chin, so that the retention system and helmet may be released and passed over and/or behind the wearer's head. The mechanical attachment includes, for example, a buckle such as a side release buckle or front release buckle, which may be made of thermoplastic, thermosets, metals or metal alloys. Furthermore, the retention system 12 optionally includes a chin pad 22 attached to the chin strap 18. The chin pad may or may not include compressible materials, such as foam or felt.

As noted above, the neck strap 24 passes behind the nape of the neck of the wearer. This may aid in reducing rotational movement of the helmet in the anterior-posterior direction and/or lateral direction. While not illustrated, a mechanical attachment may optionally be provided for opening or closing the neck strap 24. Furthermore, a neck pad 26 may be provided that rests against the nape of the neck, which is integrated into the retention system. The neck pad 26 may be removable or permanently affixed. The neck pad may or may not include compressible material, such as foam or felt.

The points of the harness 28*a*, 28*b*, 28*c*, 28*d* (hereinafter 28) include length straps 30*a*, 30*b*, 30*c*, 30*d* (hereinafter 30) that may be adjusted to lengthen or shorten the retention device. Tension locks are optionally provided for adjusting the length of each strap to aid in adjusting the straps and maintaining the adjustment. The various straps (chin, neck, length) may be formed from webbing, such as nylon webbing, or webbing made from other materials, including natural fibers such as cotton, thermoplastic materials including olefins such as polypropylene, acrylic, para-aramids (KEVLAR), ultrahigh molecular weight polyethylene (DYNEEMA), polyester, etc. Other materials, such as leather, may be utilized as well.

The retention system 12 is affixed to the helmet 10 utilizing a mechanical fastener system and attachment hooks. The mechanical fastener system includes a first mating portion and a second mating portion, which may be release-ably affixed or mated together. Preferably, the fastener system includes hook and loop fasteners and decouples under peel or shear forces.

Figure 2A:
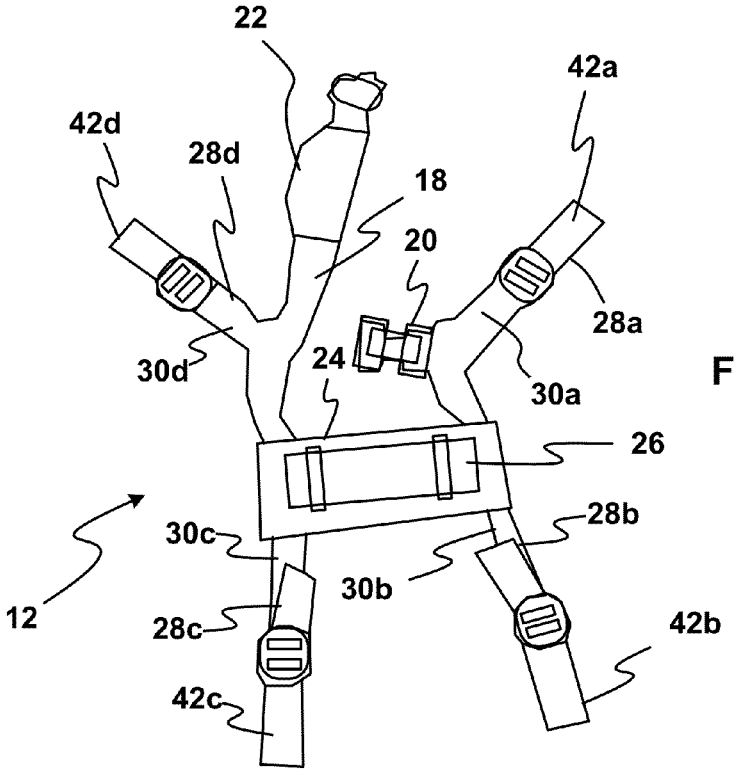
FIG. 2*a* illustrates another embodiment of a retention system including loop fastener strips for securing the retention system to the helmet.

In one embodiment, as illustrated in FIG. 1*a*, the first mating portion, affixed to the length straps 30, includes a strip of hooks 40*a*, 40*b*, 40*c*, 40*d* (hereinafter 40). In FIG. 2*a*, the first mating portion affixed to the length straps 30 includes a strip of loops 42*a*, 42*b*, 42*c*, 42*d* (hereinafter 42). The hook or loop strips are illustrated as rectangles and have an aspect ratio (length to width) of 1.1 to 1 or greater up to 10:1, squares, circles, etc, including all values and ranges therein. These geometries are collectively referred to herein as strips.

In one non-limiting embodiment, the strips on the retention system are 0.25 inches to 1.5 inches in width and in the range of 1 inch to 4 inches in length, including all values and increments therein, such as 0.75 inches in width by 2.0 inches in length, etc. Likewise, in such an embodiment, the strips on the helmet 10 are 0.25 inches to 1.5 inches in width and in the range of 1 inch to 6 inches in length, including all values and increments therein, such as 0.75 inches in width by 4.0 inches in length.

The first mating portion of the fastener 40, 42 (see FIGS. 1*a* and 2*a*) is directly or indirectly affixed to each length strap 30. For example, indirect attachment is present when a loop or D-ring is provided between the first mating portion of the fastener (hooks or loops) and the length strap. Where the fastener 40, 42 is directly affixed to the length strap, it may be affixed mechanically, such as by stitching, welding such as by ultrasonic or dielectric, chemical bonding, such as by adhesives, or by thermal means including thermal point bonding.

Figure 1B:
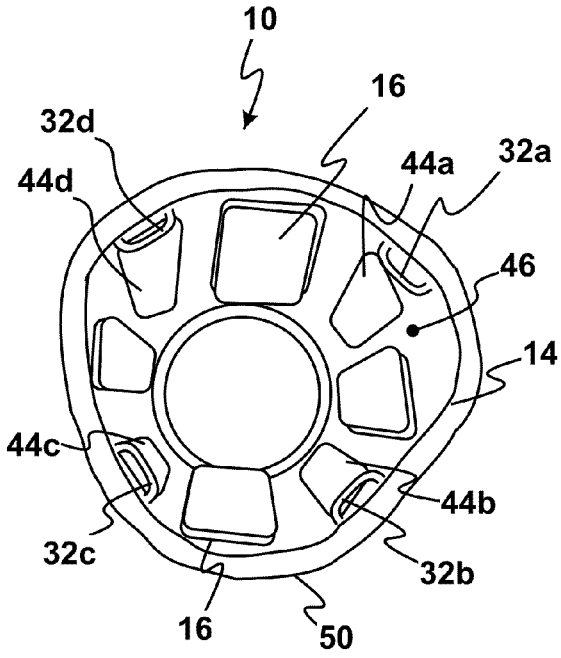
FIG. 1*b* illustrates an embodiment of a helmet including loop fastener strips for securing the retention system of FIG. 1*a* to the helmet.
Figure 2B:
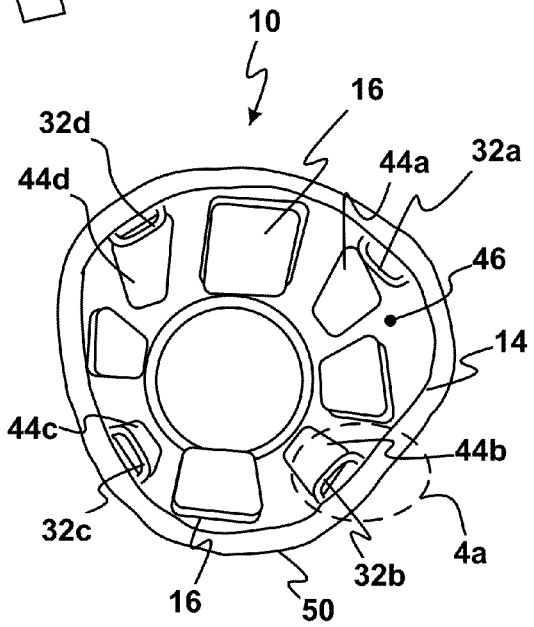
FIG. 2*b* illustrates another embodiment of a helmet including hook fastener strips for use with the retention system of FIG. 2*a*.

The second mating portion of the fastener 44, 48 (see FIGS. 1*b* and 2*b*) is affixed to the surface of the helmet. As illustrated in FIG. 1*b*, the second mating portion includes a strip of loops 44*a*, 44*b*, 44*c*, 44*d* (hereinafter 44) affixed to the interior surface 46 of the helmet shell, which mate with the hooks 40. As illustrated in FIG. 2*b*, the second mating portion includes a strip of hooks 48*a*, 48*b*, 48*c*, 48*d* (hereinafter 48) affixed to the interior surface 46 of the helmet shell, which mate with the loops 44. While not illustrated, the second mating portion is, in some embodiments, affixed to the exterior surface of the helmet shell 50. Furthermore, the second mating portions may or may not be equally spaced around the surface (interior or exterior) of the shell, depending on the application.

The second mating portions are affixed to the shell using chemical methods, mechanical methods, thermal methods or combinations thereof. In some embodiments, the second mating portions are affixed to the helmet by thermal point bonding or ultrasonic or dielectric welding to the shell, depending on the composition of the shell.

In other embodiments, the second mating portions are adhered to the shell using a pressure sensitive, solvent activated or heat activated adhesive system disposed between the second mating portion and the shell. Non-limiting examples of adhesives include acrylic, synthetic rubber, polyvinyl acetate, polyvinyl alcohol, acrylates, polyethylene, nylons, cyanoacrylates, epoxies, silicone, phenolics, polyurethanes, copolymers thereof, etc. An example of an adhesive includes a modified acrylic adhesive available from 3M under product number 9482PC PSA. Surface treatment prior to application of an adhesive includes solvent or chemical cleaning, active surface treatments (corona, flame plasma treatment), metallic, plastic, composite, elastomeric adherents, primers or promoters.

Further, in some embodiments, the adhesive may exhibit a peel strength as measured by ASTM-D-3330 (modified) 90° peel at 12 inches per minute, 22° C. and 50% relative humidity, of 70 oz./in. or greater, such as 70 oz./in. to 110 oz./in. including all values and increments therein, when tested relative to polypropylene surfaces. Greater peel strength may be exhibited when surfaces exhibiting higher surface energies are utilized and may be up to 230 oz./in.

A strip of hooks may include in the range of 400 to 2,000 hooks per square inch, including all values and ranges therein, such as 400 to 1,000 hooks per square inch or 1200 to 1500 hooks per square inch or 1400 hooks per square inch. Further, the hook height may be in the range of 0.01 to 0.05 inches, including all values and ranges therein, such as 0.02 to 0.04 inches. An example of hooks including hooks available from VELCRO under the product number HTH 792.

Figure 3:
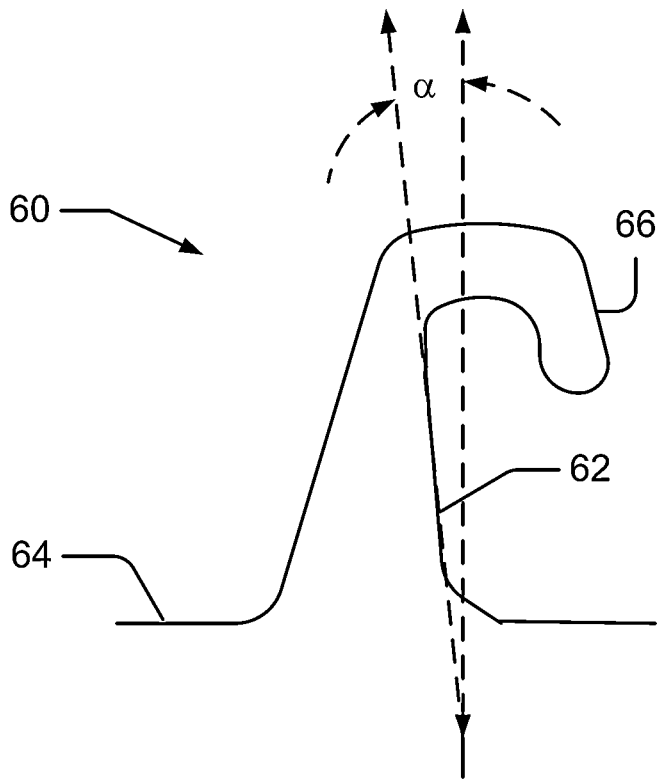
FIG. 3 illustrates a close up view of a hook of an embodiment of the hook and loop fastening system.

In some embodiments, the hook fasteners may be unidirectional hook fasteners. As illustrated in FIG. 3, unidirectional hooks 60 may include a relatively steep internal hook side wall 62, which may be set at an angle $\alpha$ in the range of 60 to 90 degrees including all values and ranges therein, such as 70 to 90 or 80 to 90 degrees from a plane generally perpendicular to the strip surface 64. Further, the end 66 of the uni-directional hooks 60 may bend nearly over itself, such that the end of the hook may be generally parallel to the interior side wall 62.

The loops may be formed from a tufted woven or non-woven textile, or a textile including a plurality of loops fixed thereon. For example, the loops may include knit loops. Examples of loops include Loop 1000 or Loop 3610, available from VELCRO.

In some embodiments, the thickness of the mated hook and loop fasteners is less than the thickness of the suspension system pieces provided within the shell. That is, the suspension system may exhibit a first thickness $T_1$ and the mated mechanical fasting system, or first and second mating portions, may exhibit a second thickness $T_2$, which is less than the first thickness $T_1$. Therefore, the wearer may not detect the presence of the fastener system within the helmet. The height of the hook and loop fastener, when mated, may be in the range of 0.03 to 0.5 inches, including all values and ranges therein.

In addition, the hook and loop fasteners may exhibit a dynamic tensile disengagement strength, when tested at 12 inches per minute at 22° C. at 50% relative humidity of 2.8 to 7.1 pounds force per square inch. The hook and loop fasteners may also exhibit a dynamic sheer strength of 40 to 42.4 pounds force per square inch, including all values and increments therein, when tested at a 1 inch by 1 inch overlap and at 12 inches per minute at 22° C. at 50% relative humidity of 2.8 to 7.1 pounds force per square inch.

Figure 4A:
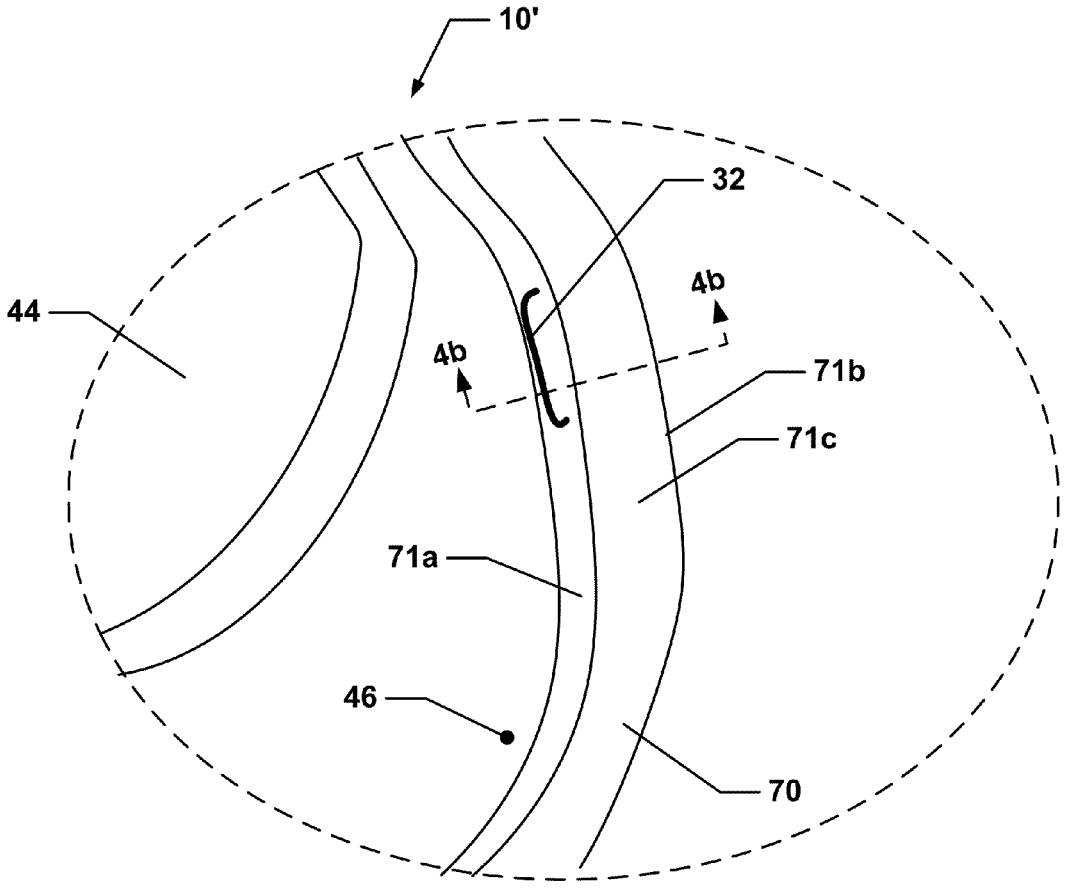
FIG. 4*a* illustrates close up view 4*a* of FIG. 2 depicting an embodiment of a helmet including an attachment hook embedded in the edge trim of the helmet.
Figure 4B:
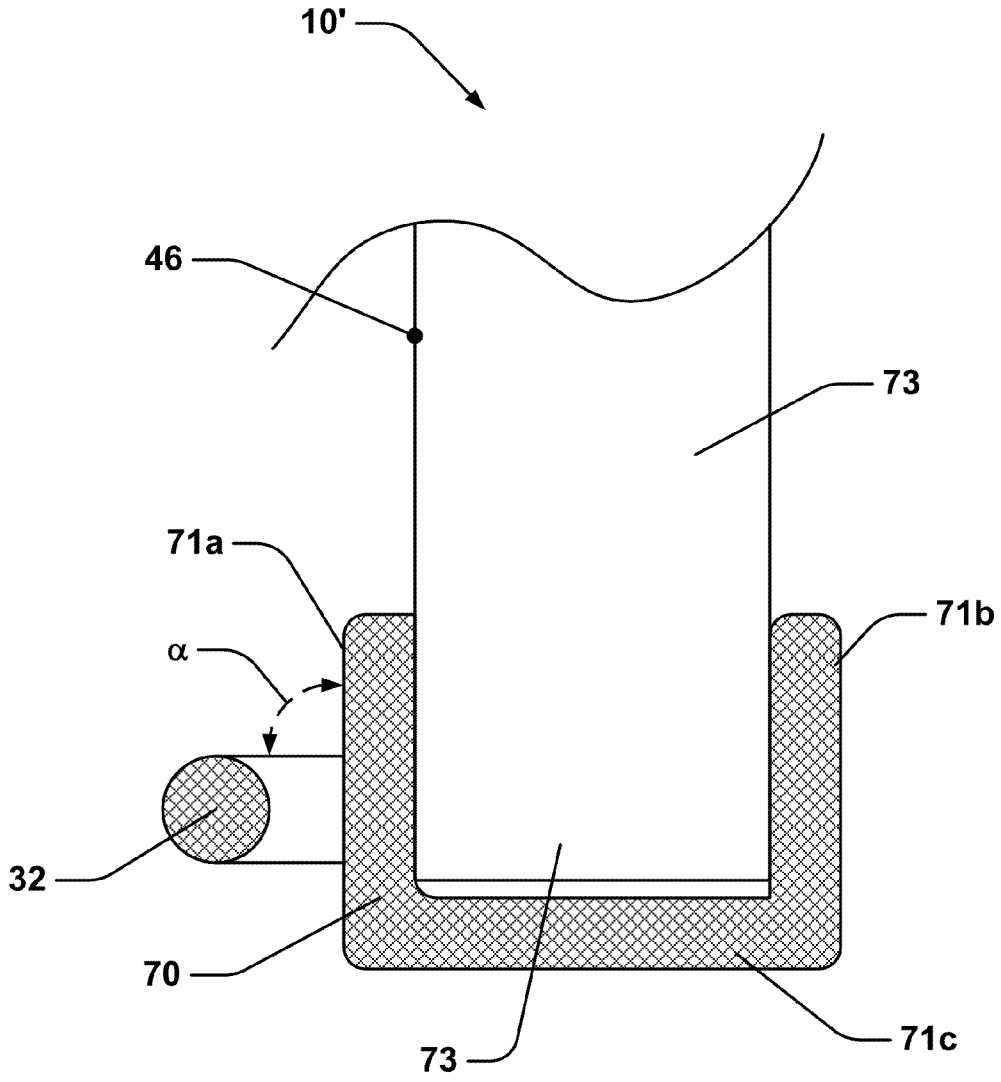
FIG. 4*b* illustrates cross-section 4*b* of FIG. 4*a* of edge trim for a helmet.

As noted above, the retention system 12 may be affixed to the helmet 10 utilizing a mechanical fastener system, including hook and loop fasteners which are threaded through an attachment hook affixed to the helmet or helmet edge trim. FIG. 4*a* illustrates an embodiment of a helmet 10' including edge trim 70. The edge trim 70 includes an attachment hook 32 affixed to the edge trim 70. The edge trim 70 may generally be in the form of a channel, as illustrated in FIG. 4*b*, including two side walls 71*a* and 71*b* and a bottom wall 71*c* for receiving the edge or rim 73 around the periphery of the helmet 10'. As illustrated, the attachment hook 32 extends into the interior of the helmet at a 90 degree angle cc from the inner side wall 71*a* of the edge trim and the interior surface of the helmet 46. The attachment hook may extend at other angles as well, such as 0 degrees to 165 degrees from the side wall, including all values and increments therein, such as from 1 degrees to 45 degrees, 45 degrees to 90 degrees, etc. At 0 degrees, the attachment hooks are generally parallel to the side walls 71*a*, 71*b* of the edge trim and helmet extending from the helmet side wall.

Figure 5A:
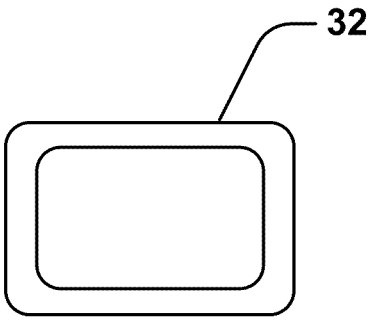
FIG. 5*a* illustrates an embodiment of an attachment hook with a closed configuration.
Figure 5B:
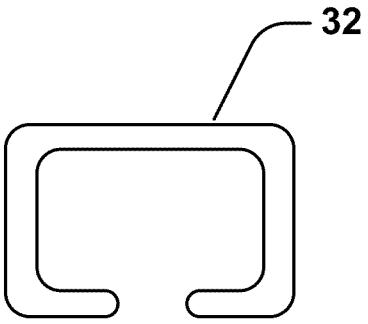
FIG. 5*b* illustrates an embodiment of an attachment hook with an open configuration.

As illustrated, the attachment hook 32 is of an oblong, rectangular or "D" configuration loop and exhibit a closed geometry or open geometry as illustrated in FIGS. 5*a* and 5*b* respectively. However, other configurations are suitable as well, including square configurations, elliptical configurations, etc. Closed geometry attachment hooks may include a closable portion, allowing for the hook to assume an open configuration and once the hook is placed in the edge trim 70 or the mechanical fixation system is attached, the hook assumes a closed configuration. Springs or other devices may be utilized to facility closure of such an attachment hook. In addition, various protrusions, barbs or other features may be present on the surface of the attachment hooks 32 to increase the surface area of engagement as between either the helmet or retention system.

Figure 6:
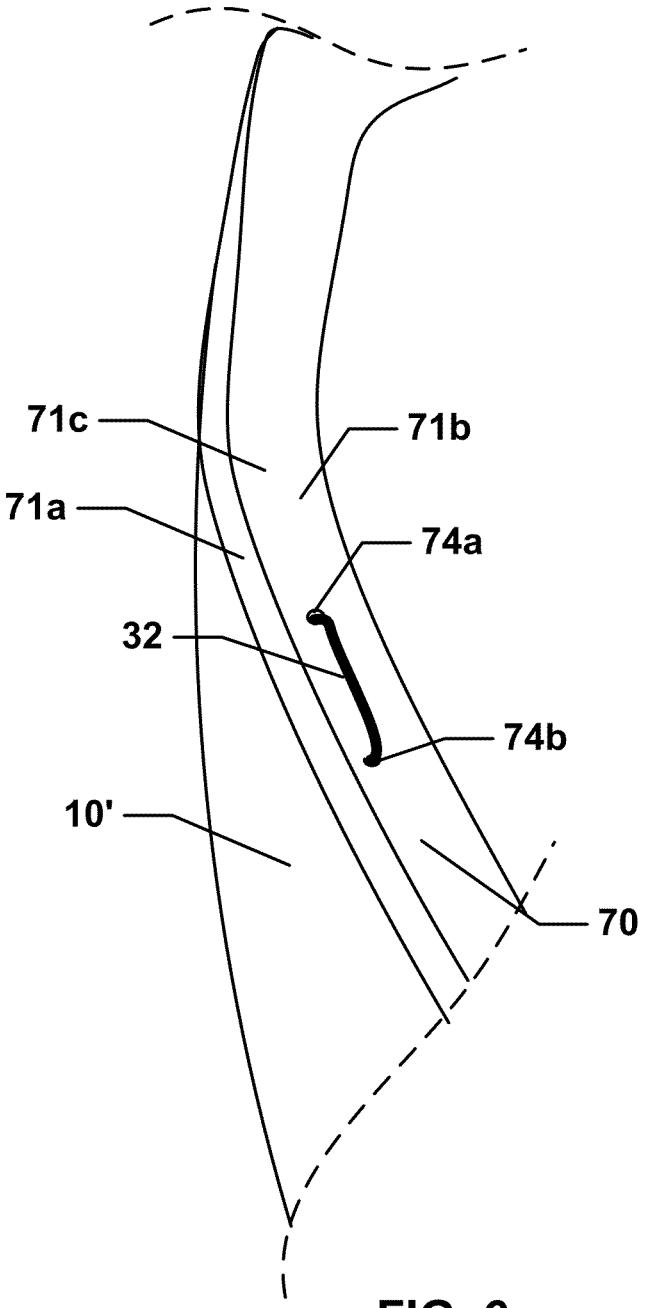
FIG. 6 illustrates an embodiment of the edge trim with an attachment hook embedded therein extending from the bottom wall of the edge trim.

FIG. 6 illustrates an embodiment, wherein the attachment hook 32 are affixed to an edge trim piece 70, extending from the bottom wall 71*c*, 0 degrees from the side wall 71*a*. In one embodiment, an open attachment hook 32 is threaded through holes 74*a*, 74*b* (hereinafter 74) provided in the bottom wall 71*c* of the edge trim piece 70. An adhesive may be utilized to further retain the attachment hook 32. In a further embodiment, the attachment hook 32 may be integrated into the edge trim 70 during molding. In other embodiments, the attachment hooks may also be molded into the helmet shell, thus upon forming of the shell, the attachment hooks are provided. The hooks may then extend through the edge trim.

The edge trim is formed of a polymer material, such as a thermoplastic polymer, including polycarbonate, acrylonitrile butadiene styrene, poly(vinyl chloride), polyamide, etc. For example, the edge trim piece may be molded by applying heat and/or pressure to a polymer material to reduce the material viscosity and causing the material to flow into a form or mold, such as through injection or compression molding. The polymer material may flow around the attachment hook and the attachment hook may be mechanically retained by the edge trim piece upon cooling and/or solidifying of the polymer material.

The edge trim piece 70 is then be affixed or otherwise adhered to the helmet 10'. In some embodiments, a chemical adhesive may be used to adhere the edge trim piece to the helmet. In other embodiments, welding, such as ultrasonic welding, may be used to affix the edge trim piece to the helmet. In additional embodiments, the edge trim piece 70 is over-molded onto the periphery of the helmet.

Figure 7:
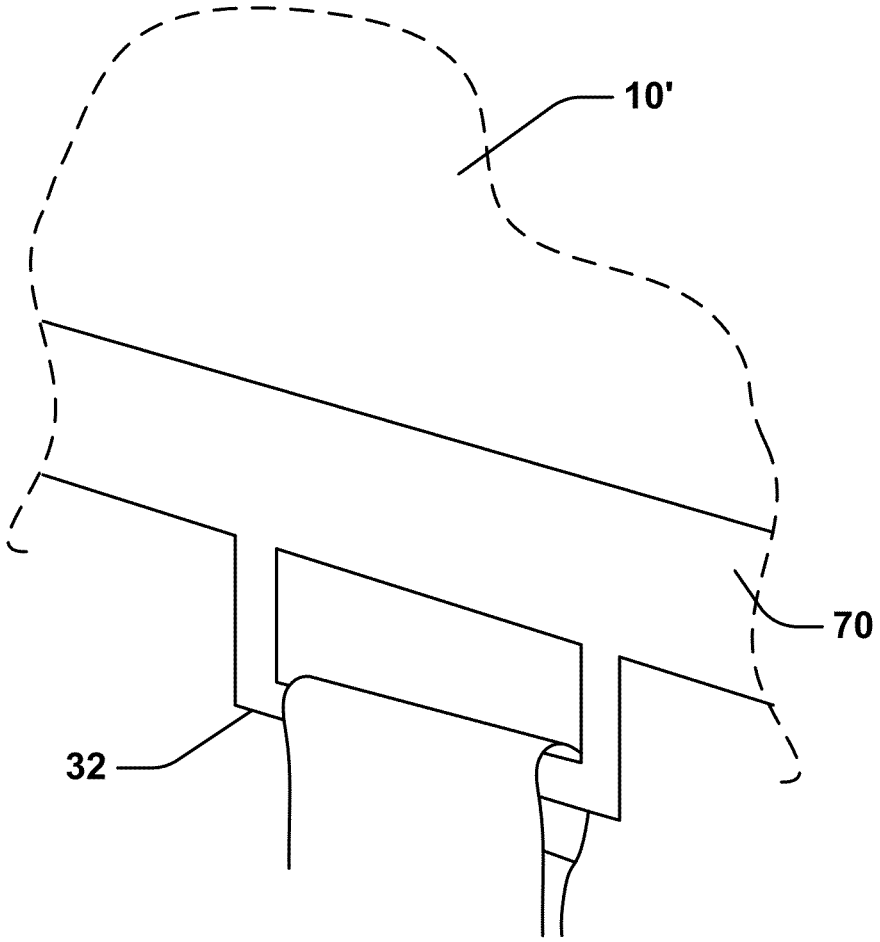
FIG. 7 illustrates an embodiment of an attachment hook with a mechanical fastener system affixing the retention system to the helmet.

In further embodiments, the attachment hook 32 is molded integrally as part of the edge trim 70, as illustrated in FIG. 7. During formation, the polymer material flows into the mold creating not only the edge trim 70, but also the attachment hook 32 in a unitary or monolithic piece. Once formed, the edge trim 70 is positioned on the helmet 10' and adhered either through mechanical means, chemical means, heat, pressure or a combination thereof. For example, the edge trim is glued to the helmet using an adhesive or welded to the helmet using ultrasonic welding.

Figure 8:
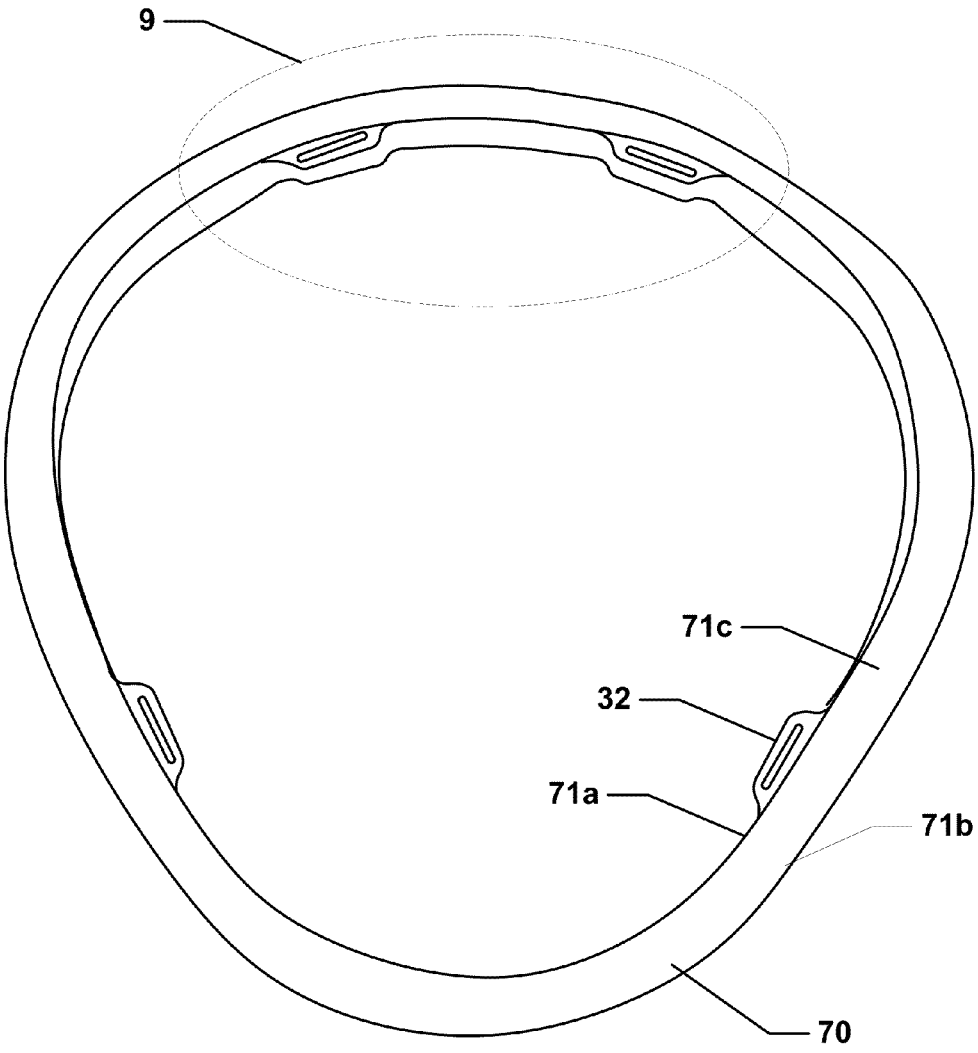
FIG. 8 illustrates an embodiment of an attachment loop molded as a portion of the edge trim piece of the helmet.
Figure 9:
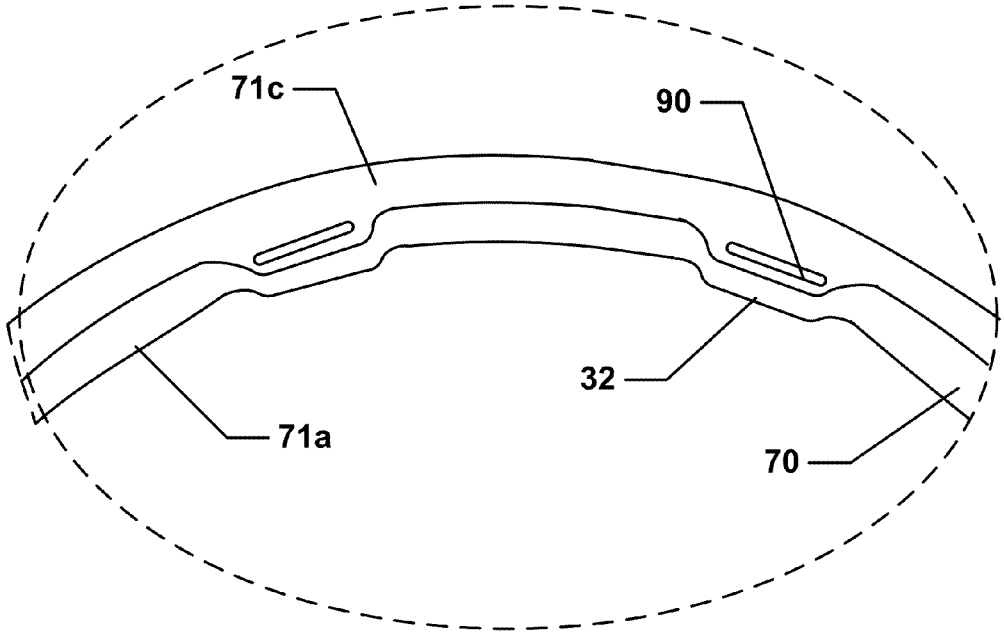
FIG. 9 illustrates the close up view 9 of FIG. 8 depicting an embodiment of an attachment loop molded as a portion of the edge trim piece of the helmet.

FIG. 8 illustrates an embodiment of an edge trim, wherein the edge trim 70 and attachment hooks 32 are integrally molded together. Again, the edge trim 70 is formed out of sheet steal or thermoplastic material such as polycarbonate, acrylonitrile butadiene styrene, poly(vinyl chloride), polyamide, etc. The edge trim may be formed by injection molding, compression molding or other forms of molding where heat and/or pressure may be applied to a material to form the edge trim. FIG. 9 illustrates a close-up of the edge trim of FIG. 8, wherein the attachment hooks 32 are formed from the side wall 71*a*. That is, to form the attachment hook 32, a portion of the side wall 71*a* may protrude or jut out from the remainder of the side wall 71*a* and a hole or opening 90 may be defined in the side wall to form the attachment hook 32.

Figure 10:
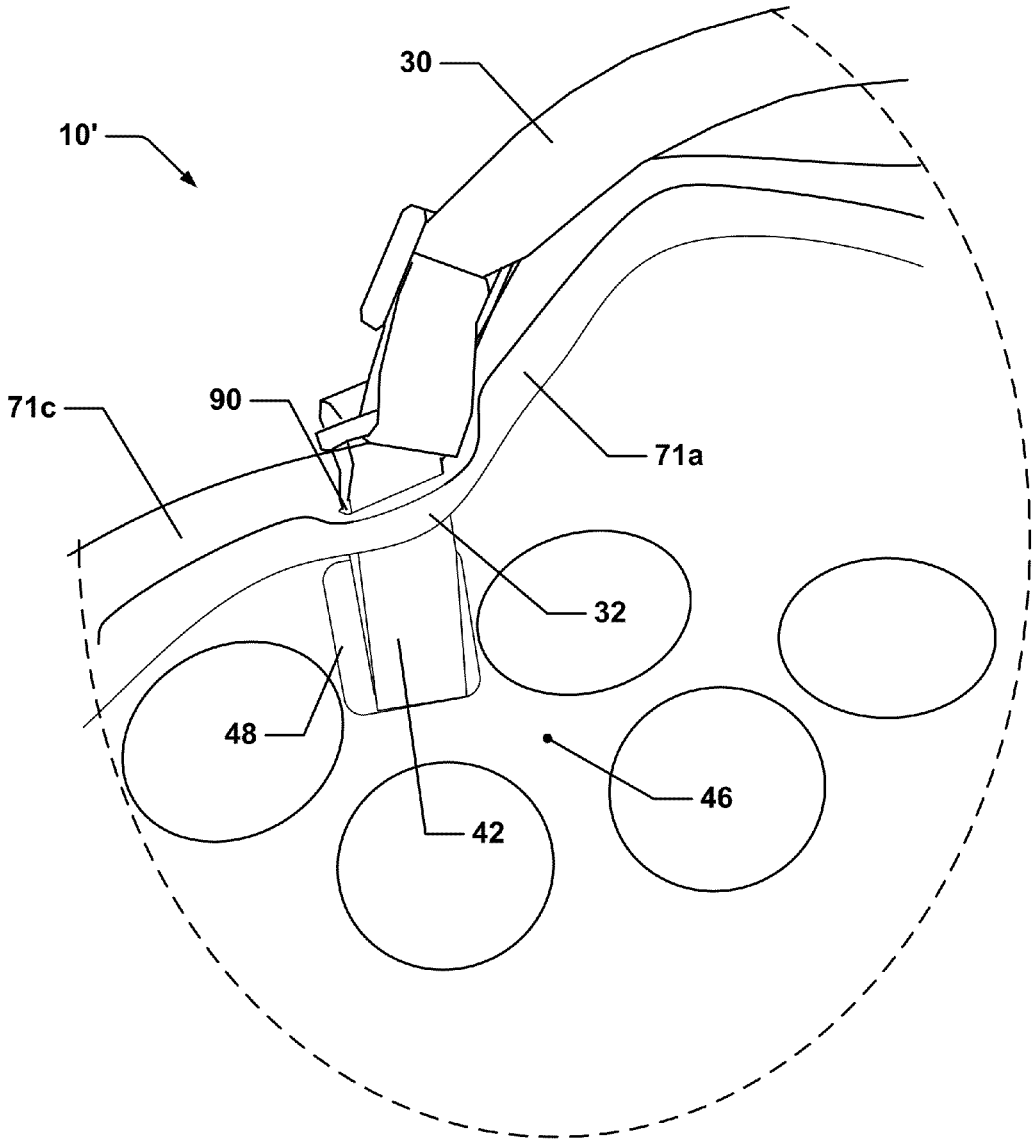
FIG. 10 illustrates an attachment hook including a mechanical fastener system to affix a retention system to a helmet.

FIG. 10 illustrates the use of the mechanical fastener system with the attachment hooks 32. The first mating portion of the retention system, such as the strip of loops 42, is threaded through the hole or opening 90 of the attachment hook 32. The first mating portion is then affixed to the second mating portion, such as the strip of hooks 48, which is in turn affixed to the interior surface 46 of the helmet 10'.

Figure 11:
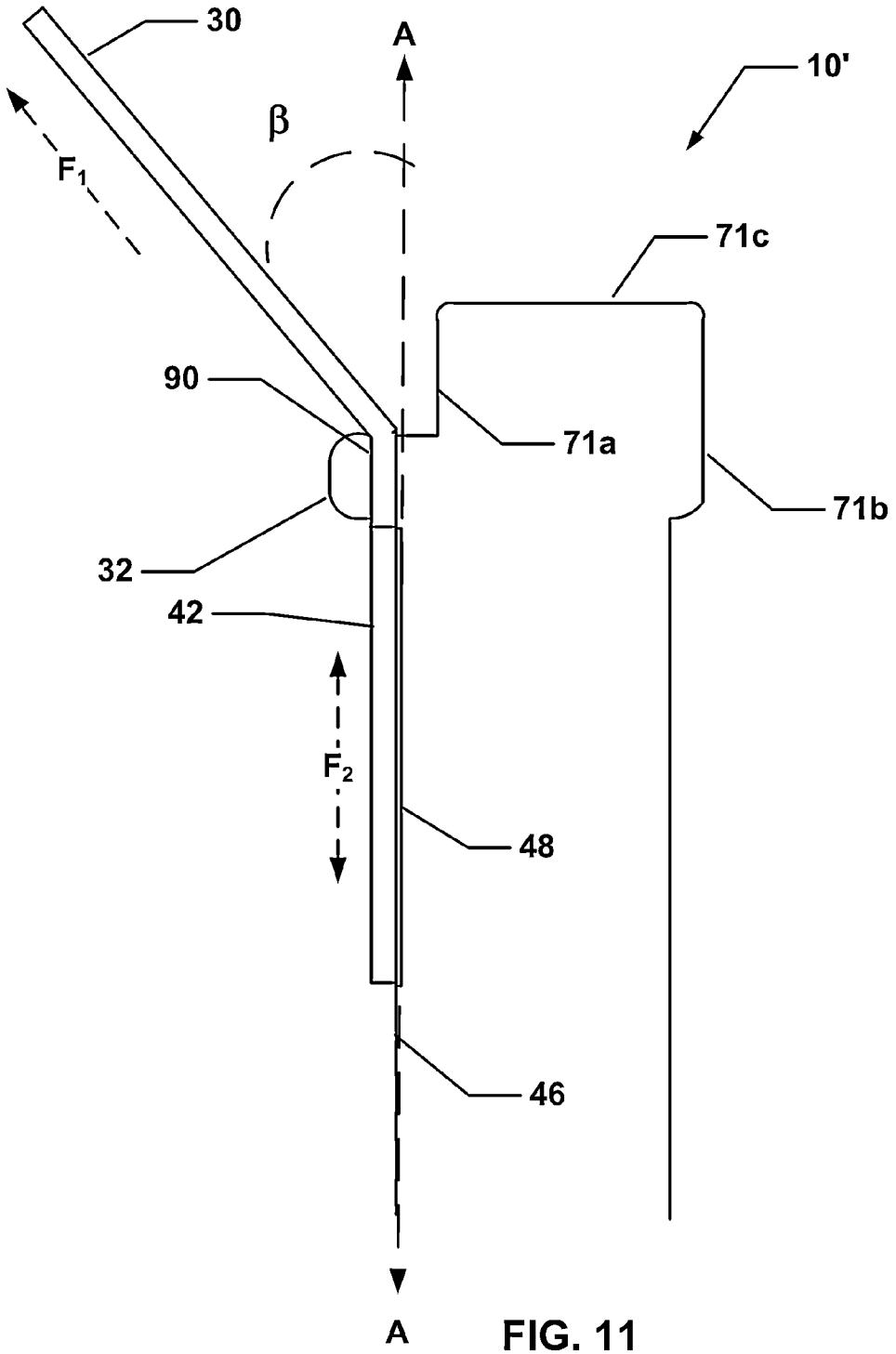
FIG. 11 illustrates a diagram of forces $F_1$ and $F_2$ applied to the mechanical fastener system.

Threading the first mating portion through the attachment hooks 32 restrains the forces that may be enacted upon the mechanical fastener system, as illustrated in the cross-section of FIG. 11. This may particularly be the case when the first mating portion is completely passed through the attachment hook. Thus, when the helmet 10' is worn, the length strap 30 of the retention system is pulled away at a given force $F_1$ from the interior wall 46 of the helmet at an angle 13 that departs from the plane (illustrated in cross-section) A-A, generally defined by the interior wall 46 of the helmet 10'. Thus, the first mating portion affixed to the second mating portion may be pulled at an angle 13 of no greater than 45°, and preferably no greater than 30° and more preferably no greater than 20°.

The attachment hook 32 constrains the forces pulling the length strap 30 away from the helmet wall 46, at angle β and generally reduces the forces pulling against the mechanical fastener 42, 48, to those parallel to the interior wall of the helmet $F_2$. As the hook and loop fastener exhibits a greater shear strength than peel strength, the retention system is less likely to decouple from the helmet 10' during normal use, i.e., when worn. The peel strength may be understood as the strength of the mechanical fastener against a force applied in a direction generally planar to the surfaces of the hook and loop fastener, which surface may be generally parallel to plane A-A. The peel strength may be understood as the strength of the mechanical fastener against a force applied in a direction at an angle, such as angle β, and away from the generally planar surfaces of the hook and loop fastener. Thus, the attachment hook 32 may prevent delaminating of the first and second portions of the hook and loop fastener.

It may be appreciated that in the above embodiment, when a force is applied against the straps in the retention system, the edge trim does not bear the entire force. Rather, most of the force is applied to the helmet and due to the presence of the attachment hooks the force is applied more as a shear force than a peel force.

In a further embodiment, when utilized with the attachment hooks 32, the fastener system may again include a first mating portion and second mating portion, which may be releaseably affixed together. Referring to the illustration in FIG. 12, the first mating portion 76 affixed to the length straps 30 (see FIG. 1 or 2) may include a strip of hooks or loops. The hook or loop strips may be provided in rectangles having an aspect ratio (length to width) of 1.1 to 1 or greater up to 10:1, squares, circles, etc. However, these geometries are collectively referred to herein as strips. In one embodiment, the strips on the retention system may be 0.25 inches to 1.5 inches in width and in the range of 1 inch to 4 inches in length, including all values and increments therein, such as 0.75 inches in width by 2.0 inches in length. The strips on the helmet 10 may be 0.25 inches to 1.5 inches in width and in the range of 1 inch to 6 inches in length, including all values and increments therein, such as 0.75 inches in width by 4.0 inches in length.

Figure 12:
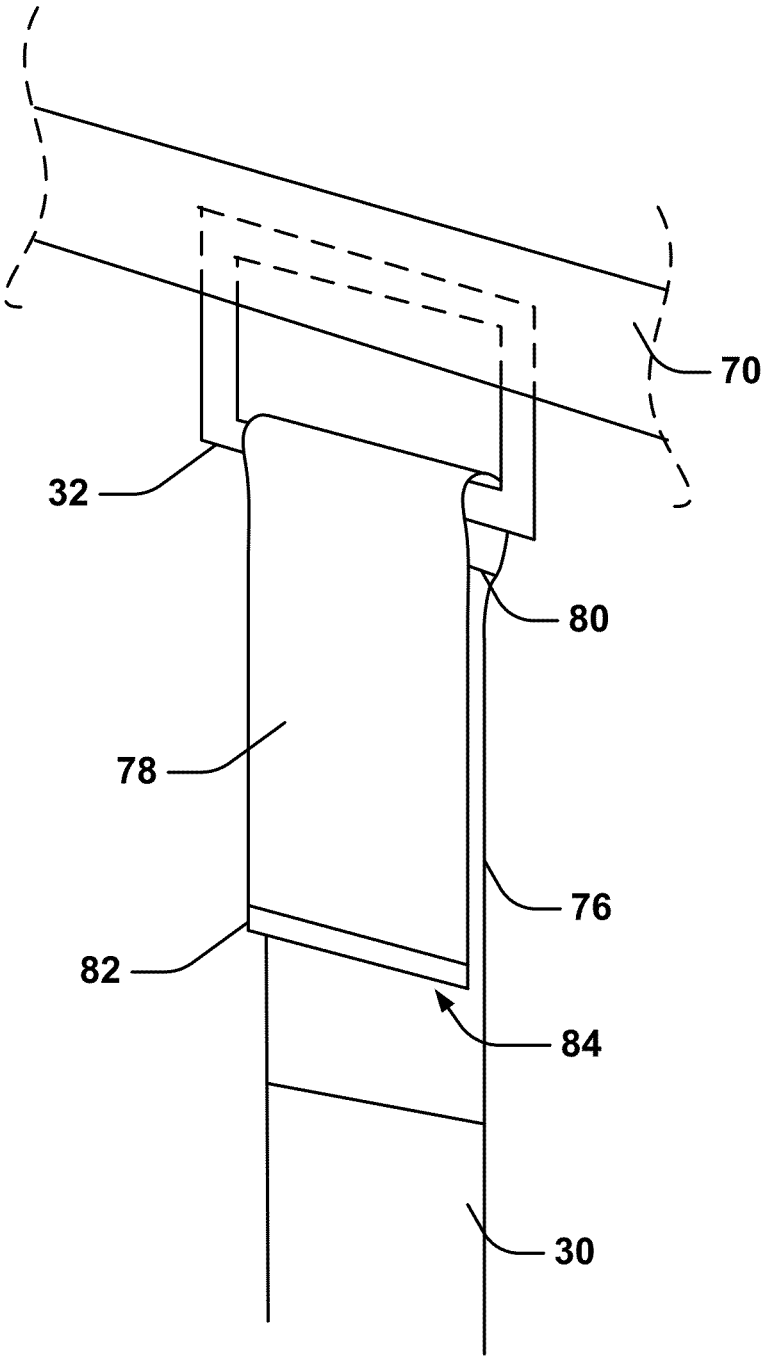
FIG. 12 illustrates an embodiment of an attachment hook molded into the edge trim of the helmet with a mechanical fastener for affixing a retention system extending therefrom.

Similar to FIGS. 1*a*, 1*b*, 2*a* and 2*b*, the first mating portion 76 may be directly or indirectly affixed to each length strap 30. The fastener (hooks or loops) may be affixed to the length strap mechanically, such as by stitching, welding such as by ultrasonic or dielectric, chemical bonding, such as by adhesives, or by thermal means including thermal point bonding. The second mating portion 78 may be affixed to the end 80 of the first mating portion. As illustrated in FIG. 12, the second mating portion may include a strip of loops. Again, the hook and loop configuration may be reversed where the loops may be affixed directly or indirectly to the length straps 30 and the hooks may be affixed to the end of the loop strip. The hook and loop strips may be threaded through the attachment hook 32 and mechanically affixed together to secure the helmet.

At the end of the first and second mating portions 76, 78, a grip is optionally provided to facilitate detachment of the retention system. The grip 82 is located at the distal end 84 of the hook and loop strips 76, 78 and includes a portion of the strap where the hooks or loops are not present. In further embodiments, the grip 82 may include a ring or loop.

It may therefore be appreciated that the retention system is affixed to the helmet using a fastener system that does not require machining through the thickness of the helmet. It is contemplated that without such machining, the mechanical integrity of the helmet may be improved. Furthermore, passages through the helmet shell are not necessary and, therefore, may not be present. It may also be appreciated that in some embodiments the helmet shell includes no metal fasteners in the retention system or in the mechanical fastening system for affixing the retention system to the helmet. Further, it may be appreciated that the injury due to mechanical fasteners such as grommets, snaps or screws may be reduced.

The hook and loop systems herein may be utilized for a variety of helmet types. For example, it is employed in tactical helmets including advanced combat helmets or riot helmets; industrial helmets including firefighting helmets, hardhats or welding helmets; sports helmets including bicycle helmets, motorcycle helmets or climbing helmets; and other applications. In utilizing hook and loop fasteners to secure the retention system to the helmet, the retention system may be easily removed if damaged. Or, if the wearer prefers a given retention system it may be readily moved from helmet to helmet.

The helmet, including the retention system, exhibits a total weight of less than 4 pounds, including all values and ranges from 2.8 pounds to 3.3 pounds, such as 3.2 pounds. The retention systems herein exhibit a pull strength of greater than 150 lbf and less then 300 lbf, such as in the range of 190 lbf to 220 lbf, including all values and ranges therein. In addition, the maximum extension at pull strength is less than 3.00 inches, including all values and ranges therein, such as 0.1 inch to 3.00 inches, 2.0 inches to 3.00 inches, 2.00 inches to 2.75 inches, etc. The pull strength of the retention systems exceed the 150 lbf minimum set under the Purchase Description for the Enhanced Combat Helmet, GL/PD 09-04 H, May 3, 2012.

The present disclosure is also directed to a method for securing a retention system of a helmet with mating portions of hook and loop fasteners. The method may include mating a first mating portion affixed to a retention system and a second mating portion affixed to a surface of a helmet by passing the first mating portion through an attachment hook provided in the helmet, securing the retention system to the helmet. The method may also include chemically securing the second mating portion onto the helmet surface. The method may also include mechanically securing the first mating portion to the retention system.

EXAMPLE

Figure 13:
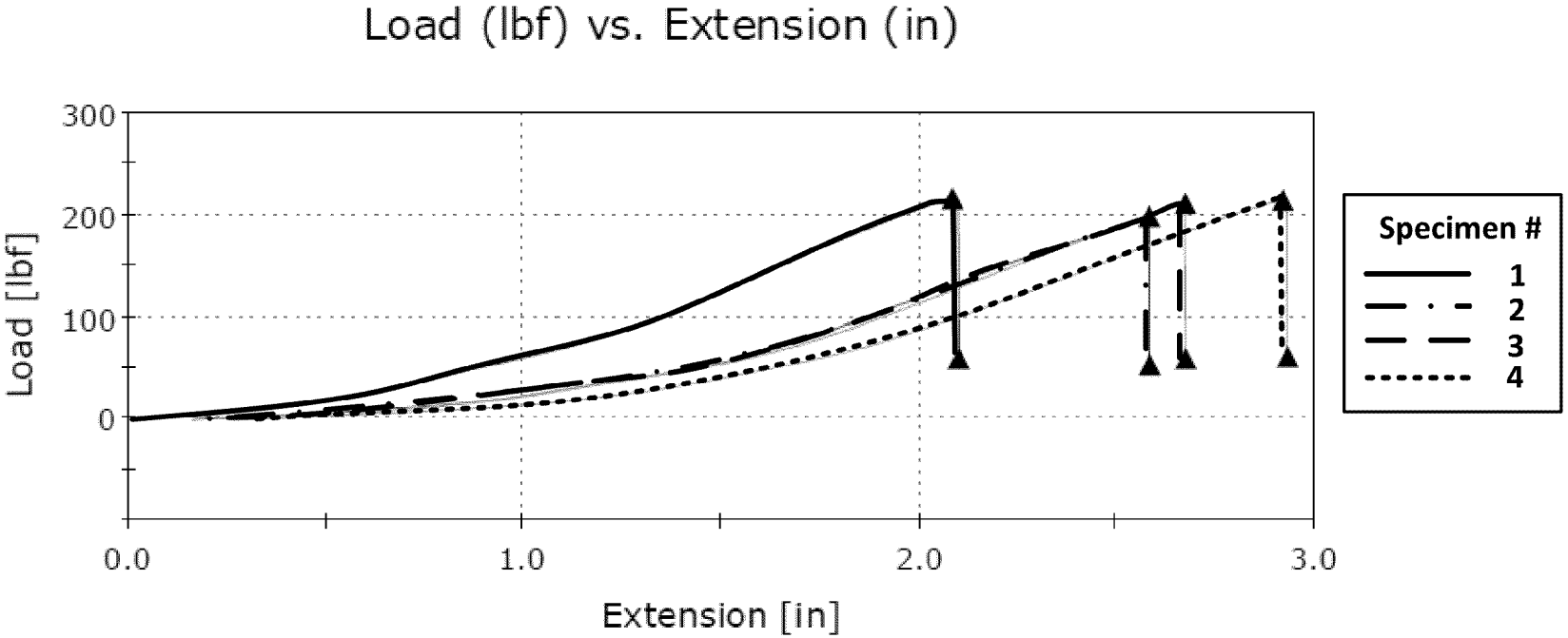
FIG. 13 illustrates the load versus extension of four sample helmets tested to determine the maximum pull strength that may be applied before failure of the retention system.

In this example, the maximum pull strength applied to the retention system before failure of the system was measured. Four ballistic helmets were manufactured according to the example set forth in FIGS. 2*a* and 2*b*, wherein the hook portion of the hook and loop fastener was adhered to the shell. VELCRO HTH 792 hooks and 3610 loops were utilized. The hooks were adhered to the helmet using 3M modified acrylic adhesive available under the product number 9482PC. Four ballistic helmets were fitted to the appropriate size Department of Transportation (DOT) Federal Motor Vehicle Safety Standard (FMVSS) 218 head form in an Instron Testing Frame. A load at the rate of 25.4 mm/min (1.0 in/min) was applied until the strap failed. Failure occurred upon breakage or release of the retention system from the headform. The testing was performed at a temperature of 70.7° F. and 29.88% relative humidity. FIG. 13 illustrates the load (pound-force) versus extension (inches). Table 1 discloses the maximum pull strength and extension at maximum pull strength in inches as well as the point of failure. As seen in the table, in half of the examples, failure occurred at the buckle and not in the adhesion strip. These values are well within the standard set forth in GL/PD 09-04 H.

TABLE 1

Helmet testing results

| Specimen | Helmet Weight (lbf) | Pull Strength (lbf) | Maximum Extension at Pull Strength (in) | Failure Point on Retention System |
|---|---|---|---|---|
| 1 | 3.2 | 216.01 | 2.08 | Front right adhesion strip |
| 2 | 3.2 | 198.55 | 2.48 | Buckle |
| 3 | 3.2 | 211.07 | 2.46 | Buckle |
| 4 | 3.2 | 214.53 | 2.61 | Front left adhesion strip |

The foregoing description of methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A helmet comprising:

a helmet shell including an edge;

an edge trim receiving the edge of the helmet shell;

a retention system including at least two straps, where the retention system is secured to the helmet;

a releasable mechanical fastening system, wherein the mechanical fastening system includes a first mating portion and a second mating portion, which releasably mates with the first mating portion, wherein the first mating portion is affixed to each of the at least two straps and the second mating portion is affixed to the helmet shell, wherein the first and second mating portions include hook and loop fasteners; and an attachment hook for each strap of the retention system extending from the edge trim through which each of the straps passes.

2. The helmet of claim 1, wherein the retention system includes at least four straps.

3. The helmet of claim 1, further comprising an adhesive disposed between the helmet shell and the second mating portion.

4. The helmet of claim 1, wherein the second mating portion is welded to the helmet shell.

5. The helmet of claim 1, wherein the helmet shell includes no metal fasteners in the retention system or in the mechanical fastening system.

6. The helmet of claim 1, wherein the attachment hooks extend perpendicularly from the shell relative to an inner side wall of the edge trim.

7. The helmet of claim 1, wherein the attachment hooks extend parallel to side walls of the edge trim and away from the helmet shell.

8. The helmet of claim 1, wherein the edge trim includes holes through which the attachment hooks pass.

9. The helmet of claim 1, wherein the attachment hooks are molded into the helmet shell.

10. The helmet of claim 1, wherein the attachment hooks are formed in the edge trim.

11. The helmet of claim 1, wherein the shell includes no passages therethrough.

12. The helmet of claim 1, wherein the helmet further comprises a suspension system.

13. The helmet of claim 12, wherein the suspension system exhibits a first thickness T 1 and when the first mating portion and the second mating portion are mated, the mechanical fastening system exhibits a second thickness T 2, that is less than the first thickness T 1.

14. The helmet of claim 1, wherein the edge trim is welded to the helmet shell.

15. A system for providing a helmet, comprising:

a retention system including at least two mating straps, wherein each strap includes a first mating portion; and a helmet shell including an edge, an edge trim receiving the edge, at least two attachment hooks extending inwardly from the edge trim, and a second mating portion affixed to the helmet shell and releasably affixed to the first mating portion;

wherein the first mating portion passes through one of the attachments hooks and the attachment hook prevents the first mating portion that is affixed to the second mating portion from being pulled at an angle of greater than 45 degrees from an interior wall of the helmet shell.

16. The system of claim 15, wherein the helmet shell includes no passages therethrough.

17. The system of claim 15, wherein the helmet further comprises a suspension system affixed to the helmet shell.

18. The system of claim 17, wherein the suspension system exhibits a first thickness T 1 and when first mating portion and the second mating portion are mated, the first and second mating portions exhibit a second thickness T 2 that is less than the first thickness T1.

19. The system of claim 15, wherein the attachment hooks are unitary with the edge trim.

* * * * *